US012429310B2

(12) United States Patent
Friling et al.

(10) Patent No.: US 12,429,310 B2
(45) Date of Patent: Sep. 30, 2025

(54) REACTIVE PROTECTIVE ARMOR

(71) Applicant: RAFAEL ADVANCED DEFENSE SYSTEMS LTD., Haifa (IL)

(72) Inventors: Samuel Friling, Kfar Vradim (IL); Ron Michaelis, Kiryat Tivon (IL); Adam Godinger, Maoz Haim (IL); Oleg Billert, Ein Yaakov (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 80 days.

(21) Appl. No.: 18/267,011

(22) PCT Filed: Dec. 20, 2021

(86) PCT No.: PCT/IL2021/051507

§ 371 (c)(1),
(2) Date: Jun. 13, 2023

(87) PCT Pub. No.: WO2022/168075

PCT Pub. Date: Aug. 11, 2022

(65) Prior Publication Data

US 2024/0060750 A1 Feb. 22, 2024

(30) Foreign Application Priority Data

Feb. 8, 2021 (IL) ..... 280731

(51) Int. Cl.
*F41H 5/007* (2006.01)
*F41H 5/04* (2006.01)

(52) U.S. Cl.
CPC ..... *F41H 5/007* (2013.01); *F41H 5/0457* (2013.01)

(58) Field of Classification Search
CPC ..... F41H 5/007; F41H 5/0457
USPC ..... 89/36.17
See application file for complete search history.

(56) References Cited

U.S. PATENT DOCUMENTS

| | | | | |
|---|---|---|---|---|
| 4,741,244 | A * | 5/1988 | Ratner | F41H 5/007 109/81 |
| 5,070,764 | A * | 12/1991 | Shevach | F41H 5/007 109/81 |
| 5,625,160 | A * | 4/1997 | Rudolf | F41H 5/007 89/36.17 |
| 8,091,465 | B2 | 1/2012 | Ravid et al. | |
| 2006/0086243 | A1* | 4/2006 | Seo | F41H 5/007 89/36.17 |
| 2007/0039837 | A1* | 2/2007 | Hanina | F41H 5/023 206/204 |
| 2009/0107326 | A1* | 4/2009 | Benyami | F41H 5/007 89/36.02 |

(Continued)

FOREIGN PATENT DOCUMENTS

| | | | | |
|---|---|---|---|---|
| WO | WO-2018122844 | A1 * | 7/2018 | F41H 5/007 |
| WO | WO-2019092693 | A1 * | 5/2019 | F41H 5/007 |
| WO | WO-2021014186 | A1 * | 1/2021 | F41H 5/007 |

*Primary Examiner* — Samir Abdosh
(74) *Attorney, Agent, or Firm* — SALIWANCHIK, LLOYD & EISENSCHENK

(57) ABSTRACT

A reactive armor for defeating threats comprises an outer shell having outer and inner surfaces, an inner reactive plate, and explosive material disposed between said inner surface and said reactive plate, wherein said reactive plate is configured to be displaced away from said inner surface upon activation of said explosive material.

14 Claims, 8 Drawing Sheets

(56) References Cited

U.S. PATENT DOCUMENTS

| | | | | |
|---|---|---|---|---|
| 2012/0186437 | A1* | 7/2012 | Cannon | F41H 5/0492 89/902 |
| 2012/0204711 | A1* | 8/2012 | Engleman | F41H 5/013 89/937 |
| 2013/0213210 | A1* | 8/2013 | Kellner | F41H 5/007 89/36.17 |

* cited by examiner

REACTIVE PROTECTIVE ARMOR

CROSS REFERENCE TO RELATED APPLICATIONS

This application is a National Stage Application of International Application Number PCT/IL2021/051507 filed on Dec. 20, 2021; which claims priority to Israel Application No. 280731, filed on Feb. 8, 2021.

FIELD OF THE INVENTION

The present invention relates to protective armor.

BACKGROUND OF THE INVENTION

Reactive armor has been used since the 1970s to defend against threats such as hollow charges, projectile forming charges and kinetic energy penetrators. While different types of reactive armors exist, their common characteristic is that, when hit by a threat, they activate a charge that "reacts" by propelling a mass, typically a heavy metal plate, toward the threat, thereby neutralizing it or at least significantly reducing its ability to penetrate the object protected by the reactive armor.

While operating in the way described above, which is common in the art, may provide effective protection, it has a substantial drawback inasmuch as the mass propelled by the charge activated inside the reactive armor may cause substantial damage to the surroundings and, of course, if activated in the vicinities of live personnel, may cause fatal injuries. Moreover, while reactive armor used in the art may be effective to neutralize the threat, it does not prevent fragments from the neutralized threat and from its own body to spread out into the surroundings, once again endangering people and equipment. It is therefore clear that it would be highly desirable to provide a reactive armor that does not possess the abovementioned disadvantages.

It is an object of the present invention to provide reactive armor that obviates the disadvantages of the prior art and is capable of affording active protection without extensive damages to the surroundings.

It is another object of the invention to provide such reactive armor, which does not allow fragments of the armor itself or of the neutralized threat to escape and endanger the surroundings.

Other objects and advantages of the invention will be better understood through the description of embodiments thereof.

SUMMARY OF THE INVENTION

The invention relates to a reactive armor for defeating threats, comprising an outer shell having outer and inner surfaces, an inner reactive plate, and explosive material disposed between said inner surface and said reactive plate, wherein said reactive plate is configured to be displaced away from said inner surface upon activation of said explosive material.

In some embodiments, the reactive armor of the invention further comprises one or more separation element adapted to absorb the movement of said inner plate when displaced away from the inner surface of the outer shell.

According to embodiments of the invention, the reactive armor may comprise a plurality of stacked reactive plates separated with additional explosive material between them. Separation elements may comprise, for instance, a plate structurally connected to the outer shell. In some embodiments, the orientation of the plate is essentially horizontal.

The outer shell of the reactive armor may, in some embodiments, comprise a back plate, which is connectable to the object to be protected. In other embodiments, the back plate is part of the object to be protected.

According to embodiments of the invention, the connection between the structural elements of the reactive armor is provided by fastening elements. Fastening elements can be of any suitable kind and shape and may be selected, for example, from among splines, inserts, hinges, screws, welding, bolts, rivets, or combinations thereof.

According to one embodiment of the invention, the reactive plate comprises reactive material encased in a light casing. In some embodiments, the light casing is made of glass or polymeric material.

In some embodiments of the invention, the reactive armor has openings provided in the outer shell, which are adapted to allow gas generated during the defeat operation of the threats to exhaust therethrough.

In some embodiments, the invention also provides a reactive armor assembly comprising two or more reactive armors according to the invention. In further embodiments, the reactive armor assembly comprises a plurality of reactive armors adjacent to one another to create larger coverage on the protected object than afforded by a single reactive armor.

DETAILED DESCRIPTION OF THE INVENTION

Figure 1A:
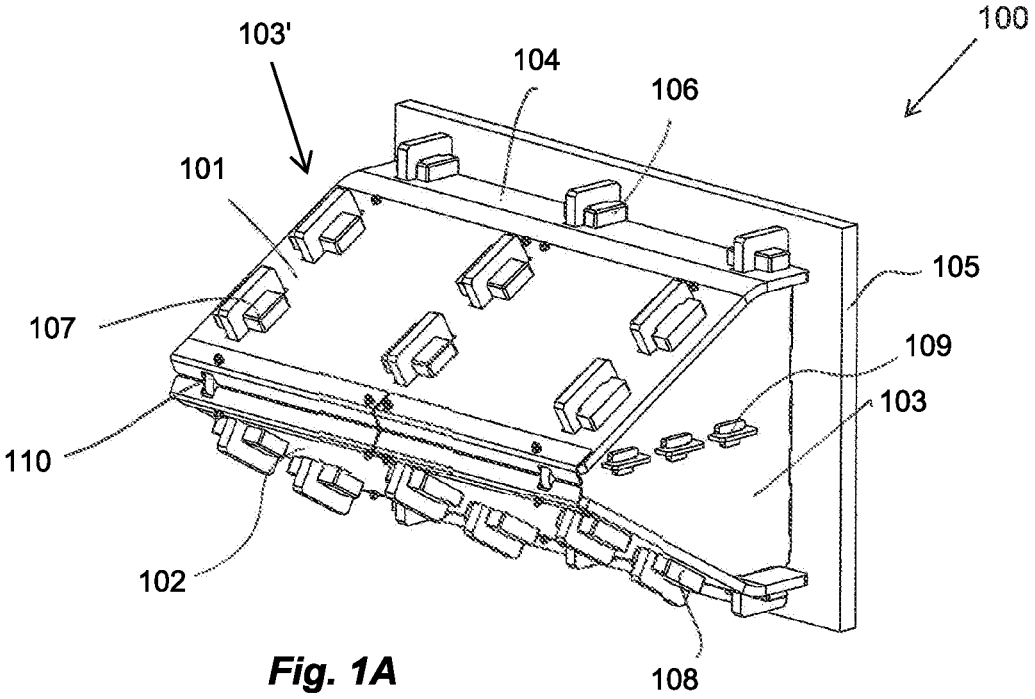
FIG. 1A is a front perspective view of the reactive armor device according to one embodiment of the invention.

FIG. 1A shows a device 100. From the outside, the device has a top plate 101 extending into top ledge 104, a bottom plate 102, side plates 103, and 103' (not shown), and a back plate 105. Back plate 105 may be part of device 100, or may be integral with the object that it is desired to protect, and adapted to receive fastening means for device 100, as will be further discussed below.

As will be appreciated by the skilled person, devices such as the reactive armor device 100 can be used to protect a variety of vehicles, be they armored vehicles, such as tanks, or lighter vehicles, but can be implemented anywhere protection is required, such as for instance on ships or buildings.

The device of the invention is, by its very nature, made of parts easily assembled and replaceable. This is achieved in one specific embodiment, by using removable fastening means instead of fixed fastening means. These may be, for instance, elements such as splines or the like that fit into openings provided in internal elements that protrude outside the envelope of device 100, as will be further described with reference to FIG. 5. For instance, in the illustrative drawings provided, the fastening means are shown as splines 106, which are used to fasten the top ledge 104 two internal parts of the device that will be described later on, but it should be understood that, throughout this description, when reference is made to splines it is interchangeably referred to alternative fastening means, such as, for example, inserts, hinges, screws, welding, bolts, or rivets, or combinations thereof.

Similarly to the above, in this illustrative figure, splines 107 are used to fasten the upper plate, splines 108 to fasten the bottom plate, and splines 109 are used to fasten the side plates. For the sake of clarity of the figure, only one spline per each plate is indicated by a number, it being understood that its description applies to all splines on the same plate. Moreover, in order to secure a strong structural behavior of device 100, the tip 110 of corner plate 103 extends into the border between tip plate 101 and bottom plate 102, as shown in the figure.

Figure 1B:
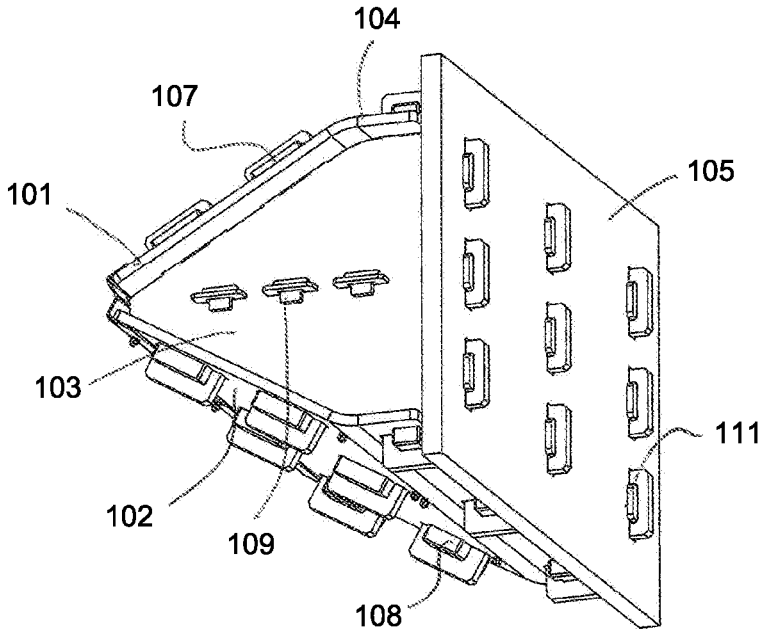
FIG. 1B is a perspective view of the device of FIG. 1A showing the back plate.

FIG. 1B shows how the device of FIG. 1A is connected to plate 105. Once again, if this plate is integral to the object that is being protected, then no additional connection means are required to fasten device 100 to said object. In the event, however, that plate 105 is not integral with the object but is part of device 100, then affixing device 100 to the object can be effected in any way known to persons skilled in the art and not discussed herein, for the sake of brevity. As is seen in this figure, connection between the various elements of device 100 and back plate 105 can also be accomplished using splines, in this case splines 111.

It should be clarified that using splines as the connecting means is advantageous and convenient for assembly purposes, but is not in any way the only viable connection for the purposes of the invention. Many other connecting methods can be employed, such as, for instance, inserts, hinges, screws, welding, bolts, or rivets, or combinations thereof, and the skilled person will select the type of connection that suits a particular purpose.

Figure 2:
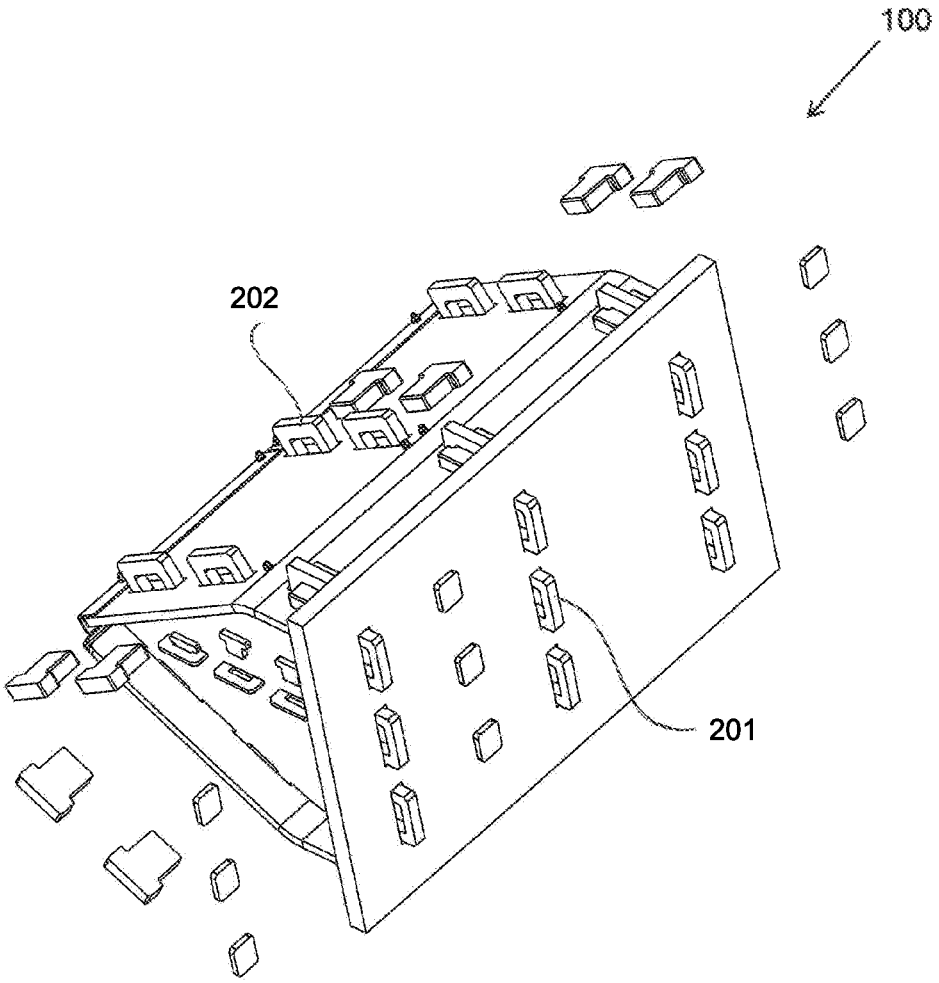
FIG. 2 shows the device of FIG. 1A with the fastening splines taken out.

FIG. 2 shows the device of FIG. 1 with splines removed. In order to illustrate the origin of the mechanical strength accomplished by the invention, it should be appreciated, for instance, that protruding portions 201 and protruding portions 202 are integral with the same internal element, which will be discussed with reference to FIG. 3.

Figure 3:
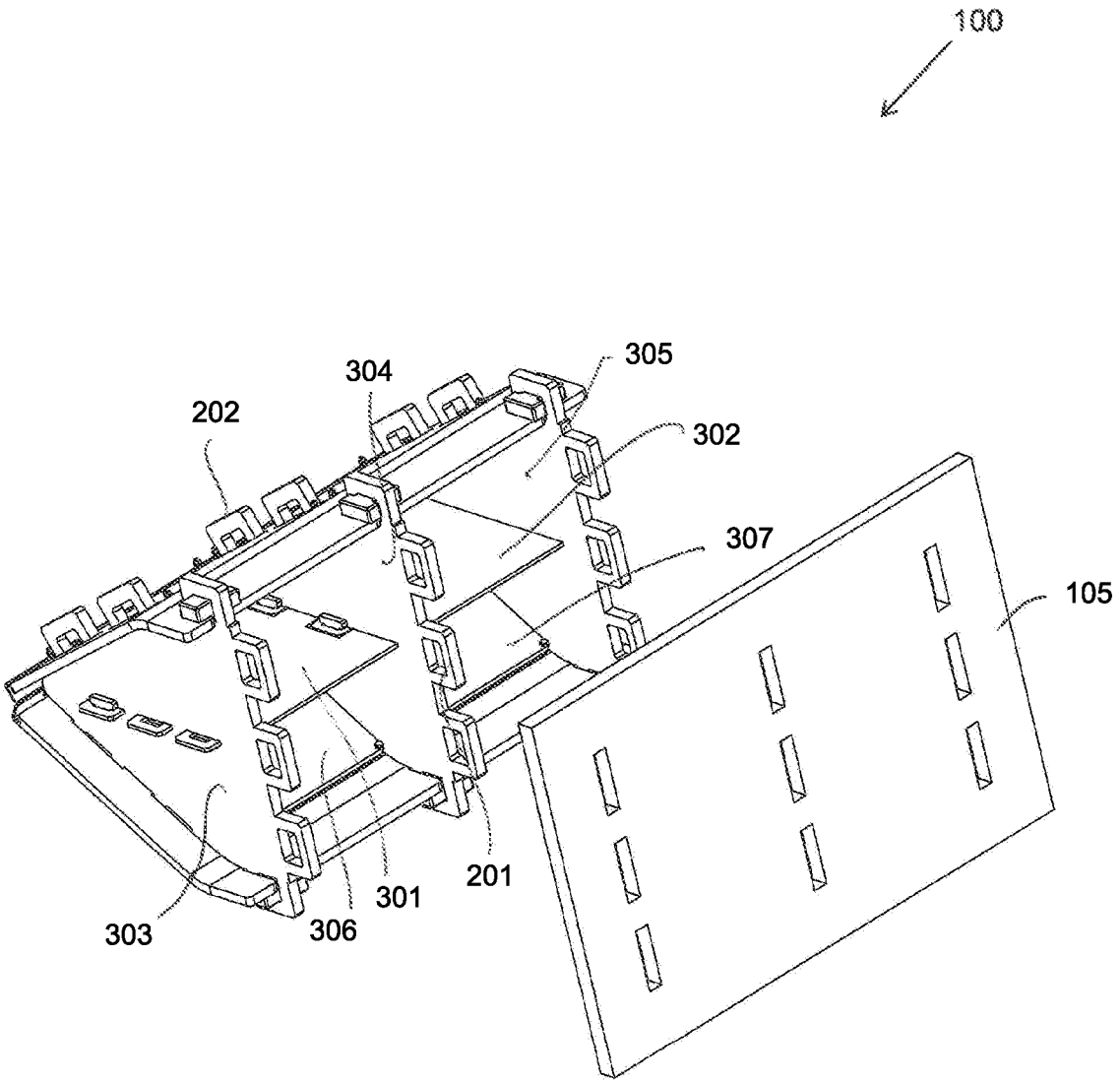
FIG. 3 shows the interior of a device according to one embodiment of the invention.

Looking now at FIG. 3, back plate 105 was removed to show the interiors of device 100. It should be understood that the device comprises plates having different roles. Horizontal plates 301 and 302 are separation plates, the purpose of which will soon be explained with reference to FIGS. 4 and 5, while plates 303, 304 and 305 are vertical separation plates that have dual purpose: they provide mechanical, structural strength to the assembled device 100, and shield the surroundings from debris that may be generated inside device 100 during operation. Referring again to FIG. 2, it is now easy to appreciate how the vertical plates impart structural stability to device 100, by looking for instance at plate 304 with its protruding ends 201 and 202, as previously explained. Internal plates 306 and 307 are reactive plates, which together with plate 501, shown in FIG. 5, perform the activities that result in the reactive protection against a threat.

As will be apparent to the skilled person, the interior of the device shown in FIG. 3 is merely illustrative and many different internal arrangements are possible. For instance, the internal device can be divided by multiple chambers in various geometries (vertical, horizontal, and hybrid arrangement), and the chamber may have a variety of shapes, such as for example, triangular, rectangular, hexagonal and other shape, as illustrated in FIG. 7(*a-e*).

Figure 8:
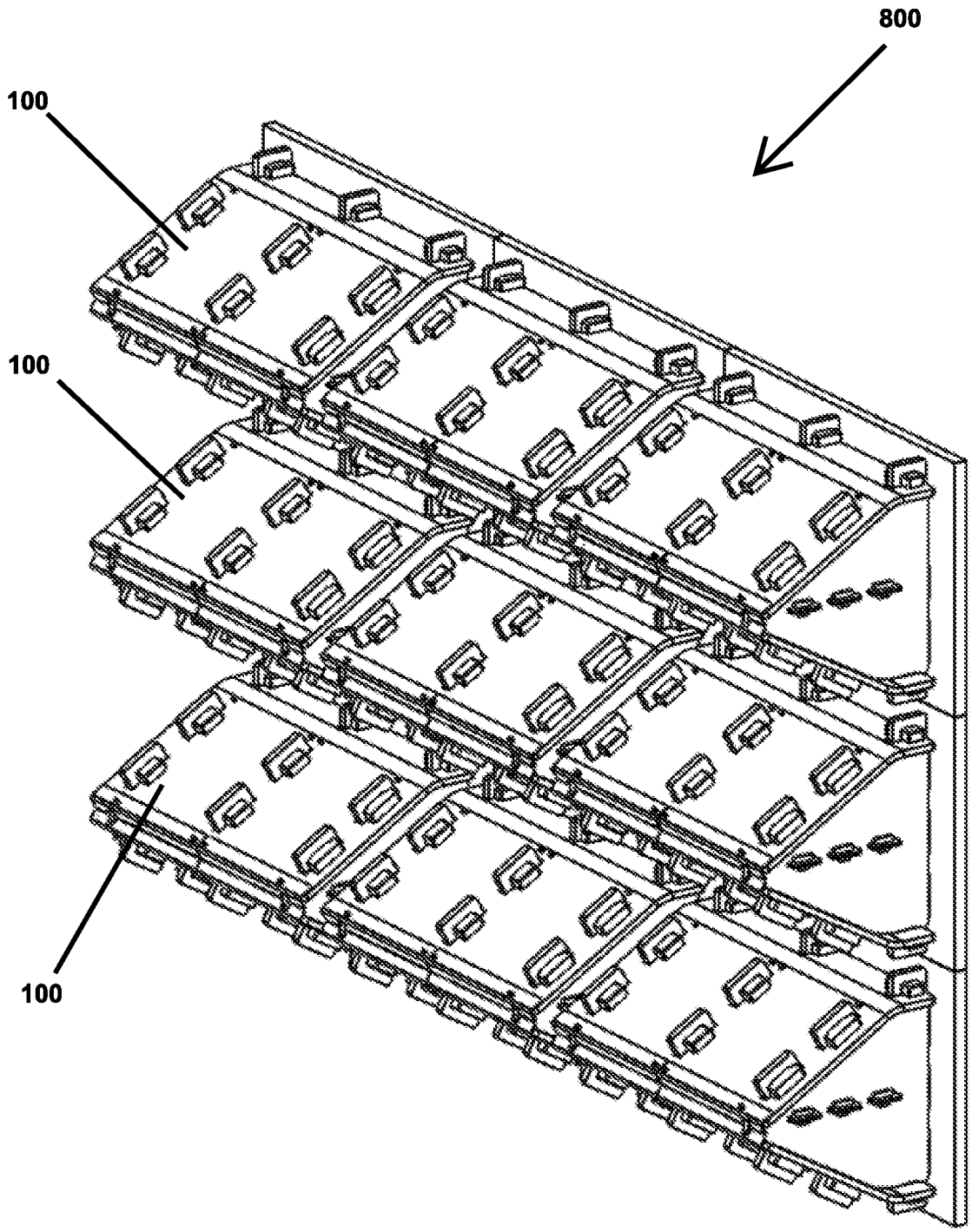
FIG. 8 illustrates further arrangements of several reactive armor devices according to an embodiment of the invention.

Other illustrative examples are shown in FIG. 8, which shows a configuration 800 in which several devices of the invention are assembled in proximity in order to enlarge the protected area coverage and to fit the protected object geometry. In the particular embodiment of FIG. 8 a plurality of devices 100 are disposed along the surface of an object to be protected. The devices must not necessarily be placed in repeating rows, and they can be distributed in any form that suits the surface to be protected, e.g., by providing rows in which the center of symmetry of the devices of some rows are offset with respect to those of other rows, or in any other manner suitable to obtain the desired coverage.

Figure 4:
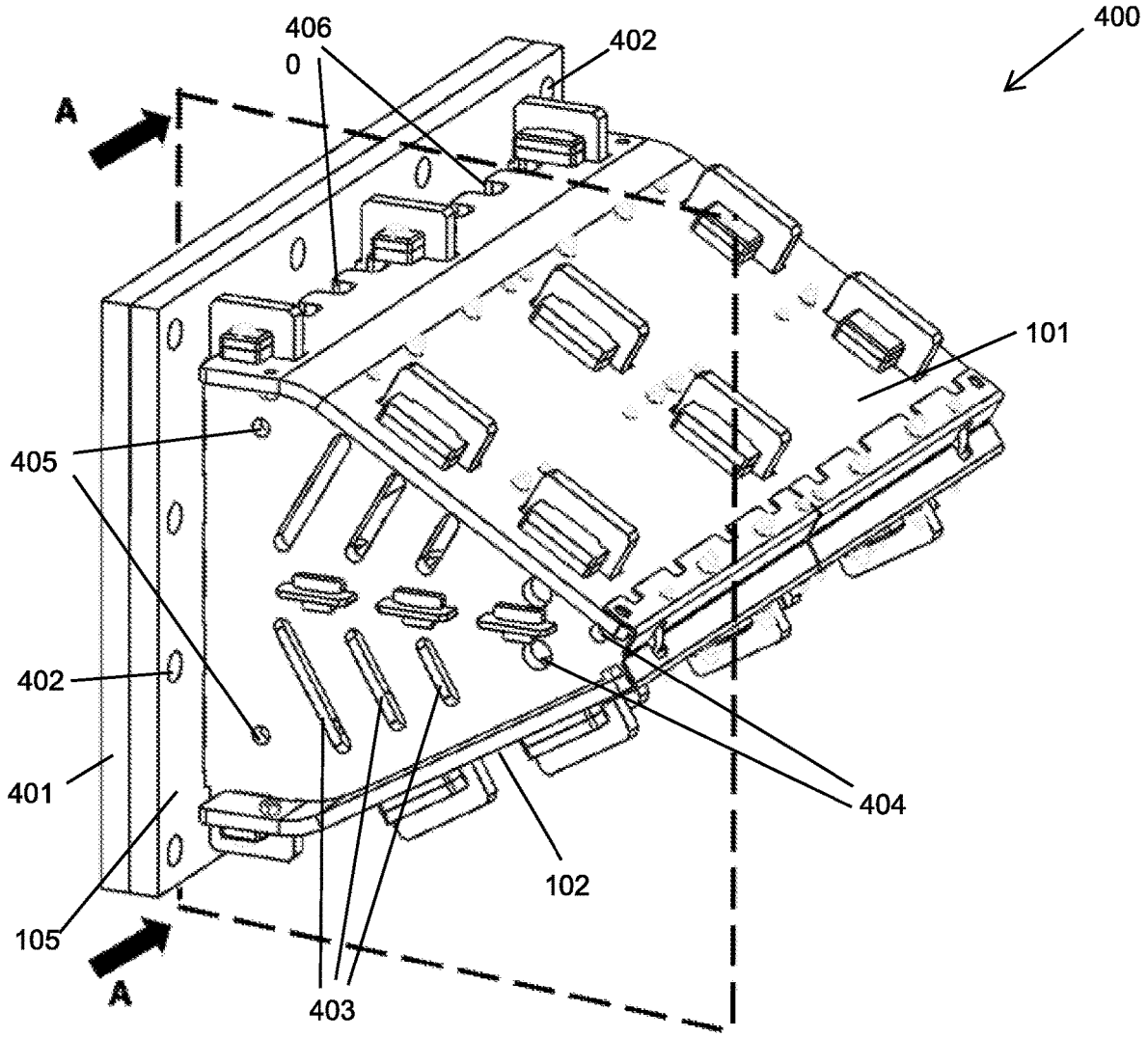
FIG. 4 shows a device according to another embodiment of the invention.

FIG. 4 shows a device 400 according to another embodiment of the invention. The basic elements shown in FIG. 1A are the same and therefore are indicated by the same numerals as in FIGS. 1A and 1B. As shown in this figure, in this embodiment plate 105 is not an integral part of the object being protected, but rather an integral part of device 400. Accordingly it is attached to wall 401 of the object (the whole object not been shown) by any suitable means, for instance a plurality of bolts 402. Also shown in the figure are openings 403, 404, 405 and 406. These are openings provided in device 400 for the purpose of allowing gases that may be generated during the operation of the device to exit. This may be needed in some cases to avoid the accumulation of pressure inside device 400, which may be dangerous and may cause deformation of the device plates. As will be understood by the skilled person, the shape, number and location of said openings may vary according to constructional and expected volumes of gas formation, and those shown in the figure are merely illustrative and not meant to limit the invention in any way.

Figure 5:
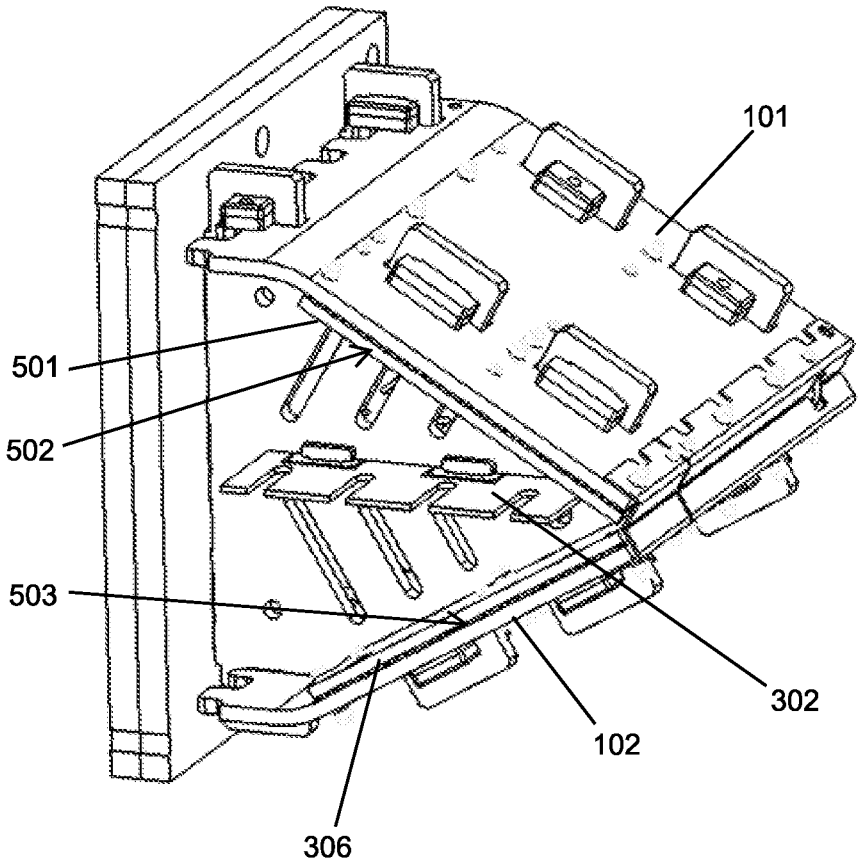
FIG. 5 is a cross-section of the device of FIG. 4, taken along the A-A plane.

FIG. 5 is a cross-section of device 400 of FIG. 4, taken along the A-A plane thereof. The figure shows separation plate 302 of FIG. 3 and two reactive plates: 306, shown in FIG. 3, and 501. Arrows 502 and 503 point to the explosive material located between the inner surface of the outer shell, and upper reactive plate 501 and lower reactive plate 306, respectively. It is the result of the actuation of said explosive materials that propels plates 501 and 306 away from the inner surface of the outer shell. When upper plate 101 is hit by a threat, the impact activates active plate 501 by detonating explosive 502, and it then collapses toward separating plate 302. Similarly, if bottom plate 102 is hit, the impact activates bottom reactive plate 306, which then collapses toward separation plate 302 from below. The ability of the reactive plates to move inside device 400 is what allows device 400 to neutralize threats without causing damage to the surroundings. Moreover, device 400 may be reused, if not critically damaged, by replacing plates that have been damaged, since the assembly and reassembly of device 400 can be done quickly and easily. The device of FIG. 5 comprises separation plates 302 that contain the movement of the collapsing, reactive plates, and while this is advantageous in some inner volume geometries, it is not an absolute requirement.

It should be understood that the arrangement shown in FIG. 5 is only an illustrative one, and plates 501 and 306 do not have to be necessarily positioned in the way shown and, moreover, it is not mandatory that only two reactive plates be present, and additional plates can be provided, separately or stacked with others. Moreover, as will be apparent to the skilled person, because the reactive part of device 400 is contained within a strong shell (e.g., one made of steel), the reactive plates can be made of light material, such as glass, polymers, etc., thus resulting in a device much lighter than devices known in the art.

It should further be clarified that the shape of the outer shell is not limited to that shown in the figures, which is one of the many possible embodiments. However, as easily understood by the man of the art, the shape of the outer shell's cross section, e.g., that taken along the A-A plane in FIG. 4 (and the resulting shape of the internal volume thereof) need not necessarily be triangular-like and may have any other shape, such as for example, square or trapezoidal, etc.

Figure 6A:
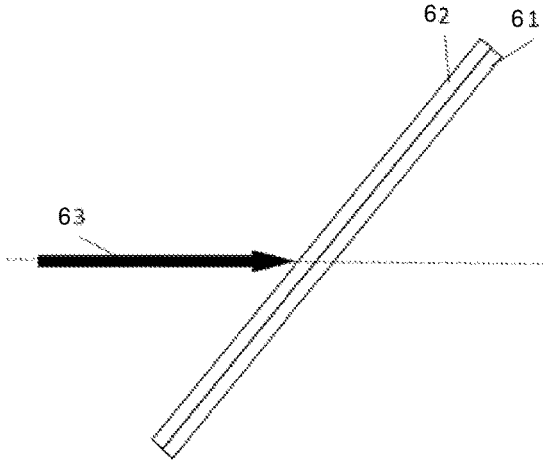
FIG. 6 is a schematic illustration of the acting principle of the invention.
Figure 6B:
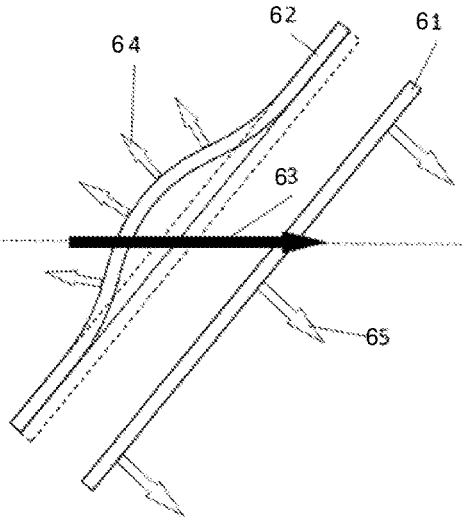
Figure 7A:
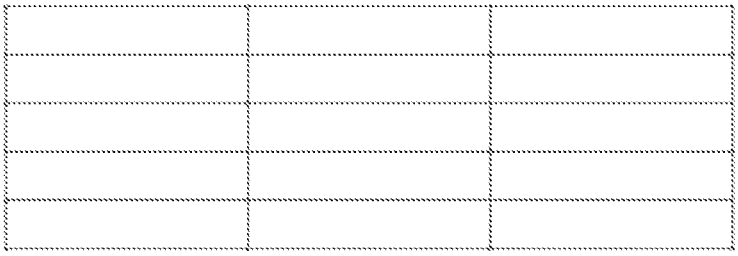
FIG. 7 schematically exemplifies some of the many possible different division of the internal volume of the device of the invention.
Figure 7B:
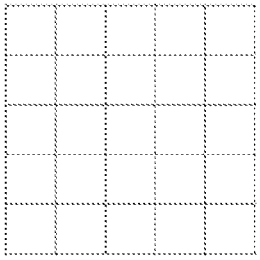
Figure 7C:
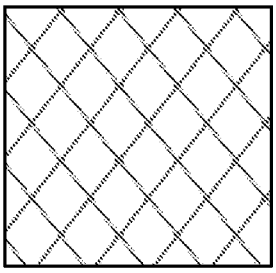
Figure 7D:
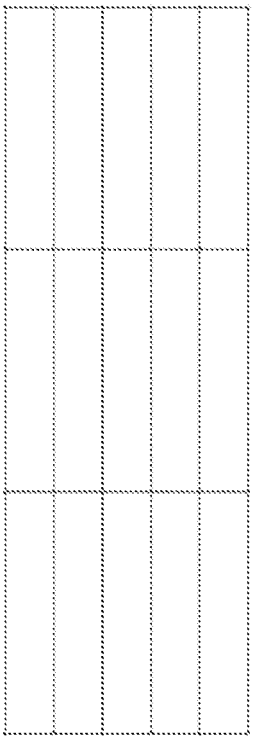
Figure 7E:
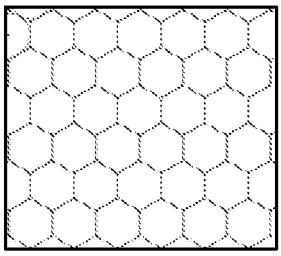

FIG. 6 schematically illustrates the principle of operation of the invention. FIG. 6(*a*) shows the device's plates before a threat 63 hits them, and FIG. 6(*b*) illustrates what happens when they are hit. Numeral 61 indicates an internal plate, and numeral 62 an external plate. During the penetration of threat 63, internal plate 61 moves, while external plate 62 remains at its place and protects the environment from explosion products. Deformation of plate 2 is indicated by numeral 64, and the movement of plate 1 by numeral 65. In this illustrative drawing the line of sight is indicated by numeral 66.

Diametrically different principles are known in the art as illustrated, for instance, in U.S. Pat. No. 9,032,858, in which the external plate (65 in FIG. 6) moves toward the threat and the entire device is destroyed, as clearly shown in FIG. 7 of said patent.

All the above description of embodiments of the invention have been provided for the purpose of illustration and are not meant to limit the invention in any way. As will be apparent to the skilled person, devices of the invention can be provided in different sizes and shapes, comprising different numbers of compartments and reactive elements, all without exceeding the scope of the invention.

The invention claimed is:

1. A reactive armor for defeating threats, comprising an outer shell having outer and inner surfaces, an inner reactive plate, and explosive material disposed between said inner surface and said reactive plate, wherein said reactive plate is configured to be displaced away from said inner surface upon activation of said explosive material, comprising a plurality of stacked reactive plates and separated with additional explosive material between them.

2. The reactive armor according to claim 1, further comprising one or more separation element adapted to absorb the movement of said inner plate when displaced away from the inner surface of the outer shell.

3. The reactive armor according to claim 2, wherein the separation element comprises a plate structurally connected to the outer shell.

4. The reactive armor according to claim 3, wherein the orientation of the plate is essentially horizontal.

5. The reactive armor according to claim 1, wherein the outer shell comprises a back plate.

6. The reactive armor according to claim 5, wherein the back plate is connectable to the object to be protected.

7. The reactive armor according to claim 5, wherein the back plate is part of the object to be protected.

8. The reactive armor according to claim 1, wherein the connection between its structural elements is provided by fastening elements.

9. The reactive armor according to claim 8, wherein the fastening elements are selected from splines, inserts, hinges, screws, welding, bolts, rivets, and combinations thereof.

10. A reactive armor for defeating threats, comprising an outer shell having outer and inner surfaces, an inner reactive plate, and explosive material disposed between said inner surface and said reactive plate, wherein said reactive plate is configured to be displaced away from said inner surface upon activation of said explosive material, wherein the reactive plate comprises reactive material encased in a light casing.

11. The reactive armor according to claim 10, wherein the light casing is made of glass or polymeric material.

12. The reactive armor according to claim 1, comprising openings in the outer shell adapted to allow gas generated during the defeat operation of the threats to exhaust therethrough.

13. A reactive armor assembly comprising two or more reactive armors according to claim 1.

14. The reactive armor assembly according to claim 13, comprising a plurality of reactive armors adjacent to one another to create larger coverage on the protected object than afforded by a single reactive armor.

* * * * *